US009914234B2

(12) United States Patent
Baggot et al.

(10) Patent No.: US 9,914,234 B2
(45) Date of Patent: Mar. 13, 2018

(54) MULTILATERAL CUTTER

(71) Applicant: Kimberly-Clark Worldwide, Inc., Neenah, WI (US)

(72) Inventors: James Leo Baggot, Menasha, WI (US); Robert Eugene Krautkramer, Combined Locks, WI (US); Kyle Andrew Krautkramer, Kaukauna, WI (US); Gregory Michael Bixler, Appleton, WI (US); Matthew Robert Wilson, Oshkosh, WI (US); Frank Stephen Hada, Appleton, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 165 days.

(21) Appl. No.: 14/993,642

(22) Filed: Jan. 12, 2016

(65) Prior Publication Data

US 2016/0121501 A1 May 5, 2016

Related U.S. Application Data

(63) Continuation-in-part of application No. 13/780,718, filed on Feb. 28, 2013, now abandoned.

(51) Int. Cl.

| | |
|---|---|
| ***B26D 5/00*** | (2006.01) |
| ***B26D 7/26*** | (2006.01) |
| ***B26D 1/40*** | (2006.01) |
| ***B26F 1/20*** | (2006.01) |
| ***B26F 1/10*** | (2006.01) |

(52) U.S. Cl.

CPC ..... *B26D 5/005* (2013.01); *B26D 1/405* (2013.01); *B26D 7/2628* (2013.01); *B26F 1/10* (2013.01); *B26F 1/20* (2013.01); *Y10T 83/162* (2015.04); *Y10T 83/4737* (2015.04); *Y10T 83/4838* (2015.04)

(58) Field of Classification Search

CPC ..... B26D 1/626; B26D 1/40; B26D 11/00; B26D 5/08; B26D 7/20; B26D 1/405; B26F 1/20; B26F 1/0092; Y10T 83/175; Y10T 83/9408; Y10T 83/4838; Y10T 83/4737; Y10T 83/162; B23D 5/005

USPC ..... 83/343, 76.7, 37, 304, 346, 678, 76.1, 83/76.6, 76.9, 74, 287, 311

See application file for complete search history.

(56) References Cited

U.S. PATENT DOCUMENTS

| | | | |
|---|---|---|---|
| 2,670,796 | A | 3/1954 | Orr |
| 3,190,163 | A | 6/1965 | Bradley |
| 3,716,132 | A | 2/1973 | Lewyckyj |
| 3,771,399 | A | 11/1973 | Aterianus |
| 3,847,045 | A | 11/1974 | Willhite et al. |

(Continued)

FOREIGN PATENT DOCUMENTS

| | | | |
|---|---|---|---|
| GB | 1 316 670 | A | 5/1973 |

*Primary Examiner* — Ghassem Alie

(74) *Attorney, Agent, or Firm* — Kimberly-Clark Worldwide, Inc.

(57) ABSTRACT

The present invention provides a perforating station comprising two or more discrete perforating stations, the stations synchronized with one another to cut a line of perforations across a web, such as a web of tissue paper, moving at high speeds. By providing two or more synchronized perforating stations the perforating station may increase the number of impacts per minute compared to prior art perforating devices.

8 Claims, 3 Drawing Sheets

(56) References Cited

U.S. PATENT DOCUMENTS

| | | | | |
|---|---|---|---|---|
| 4,074,599 | A | 2/1978 | Allen | |
| 4,397,204 | A | 8/1983 | Colombo | |
| 5,117,718 | A | 6/1992 | Wittkopf | |
| 5,387,298 | A | 2/1995 | Takagi et al. | |
| 5,720,223 | A | 2/1998 | Meschi | |
| 5,755,654 | A | 5/1998 | Schulz et al. | |
| 5,797,305 | A | 8/1998 | Harrod et al. | |
| 6,009,781 | A | 1/2000 | McNeil | |
| 6,220,134 | B1 | 4/2001 | Thiel et al. | |
| 6,296,601 | B1 | 10/2001 | Couturier | |
| 6,460,441 | B1 | 10/2002 | Harrod | |
| 6,698,323 | B2 | 3/2004 | Formon et al. | |
| 6,945,922 | B2 | 9/2005 | Baggot et al. | |
| 7,183,736 | B1 | 2/2007 | Chou et al. | |
| 8,602,957 | B2 * | 12/2013 | Sandahl ..... | B41F 13/60<br>493/324 |
| 2003/0036812 | A1 | 2/2003 | Christ et al. | |
| 2005/0034582 | A1 | 2/2005 | De Marco et al. | |
| 2008/0028902 | A1 | 2/2008 | Baggot et al. | |
| 2010/0101386 | A1 | 4/2010 | Jackson et al. | |
| 2010/0122613 | A1 | 5/2010 | Sandahl | |
| 2010/0167896 | A1 | 7/2010 | Hada et al. | |
| 2011/0068531 | A1 | 3/2011 | Gentle et al. | |
| 2012/0055358 | A1 | 3/2012 | Cote et al. | |

* cited by examiner

MULTILATERAL CUTTER

RELATED APPLICATIONS

The present application is a continuation-in-part application and claims priority to U.S. patent application Ser. No. 13/780,718, filed on Feb. 28, 2013, which is incorporated herein by reference.

BACKGROUND

Methods and apparatuses intended to cut or produce lines of perforations in a moving target web are well known in the art. Conventional processes and machines have included a rotary knife roll and a stationary anvil. The rotary knife rolls have included removable and replaceable knife blades, which have extended generally along the axial direction of the knife roll, and have been distributed along the circumference of the knife roll with regular or irregular, intermittent spacing. In addition, the knife blades have been placed at an angle relative to the rotational axis of the knife roll. The placing of the blades on the roll at an angle has helped to reduce the impact loads generated during the cutting of the target web. In particular arrangements, it has also been necessary to skew the axis of rotation of the knife roll relative to the direction of the web movement past the knife roll. The amount of skewing has been suitably adjusted to obtain substantially straight cuts along the transverse cross-direction of the target web. Conventional techniques and devices are well known in the art, and suitable anvils and rotary knife rolls are available from commercial vendors.

Ordinary methods and apparatuses, however, have not provided desired combinations of efficiency and versatility, particularly when the cutting processes are operated with high web speeds. When conventional processes and machines have been arranged to cut a target web that is moving at high speeds past the anvil, the impact forces between the blade and the anvil have caused high rates of wear requiring frequent changing of the knife and anvil blades. To reduce wear, the amount of interference between the knife and anvil blades has been set to relatively small values. The small values of interference help to reduce wear, but can lead to areas of missing perforations in the web, due to vibrations in the components of the equipment and variations in the setup of the equipment. A poor quality in the perforations is not only poorly received by the final consumer using the product, but can also lead to a poor operation of the manufacturing process. For example, an individual perforation line is typically used as the separation line between rolls of finished product; and a poor quality perforation line can disrupt the reliability and quality of the separation process. It has also been cumbersome and time-consuming to reconfigure conventional systems to produce different spacing between the desired cut locations along the lengthwise movement direction of the target web. As a result, there has been a continued need for improved cutting systems that provide improved reliability and versatility, along with an improved and more reliable definition of the perforation line.

SUMMARY

To overcome the limitations of prior art perforating devices, the present inventors now provide a perforating apparatus comprising two or more discrete perforating stations, the stations synchronized with one another to cut a line of perforations across a web, such as a web of tissue paper, moving at high speeds. By providing two or more synchronized perforating stations the rate of tissue web perforation may be increased. Accordingly, in certain embodiments the present invention provides two or more perforating stations in synchronized control with one another, the synchronized perforating stations being capable of efficiently perforating a web, such as a tissue web, at impact rates greater than about 7,000 impacts per minute and more preferably greater than about 7,500 impacts per minute, with low vibrational energy and without damaging the web.

In another embodiment the present invention provides an apparatus for intermittently cutting a moving target web traveling at a web speed ($V_W$) comprising a first perforating station comprising a first rotating knife roll having at least one knife member to provide an operative knife-member speed and position and a first anvil member; a second perforating station comprising a second rotating knife roll having at least one knife member to provide an operative knife-member speed and position and a second anvil member; a drive means for driving the first and second knife rolls; and a control means for coordinating the operative knife-member speed and position of the first and second knife members. Generally the first and the second knife rolls are driven at a knife-member speed of V1, which is preferably different than the web speed ($V_W$). That is there is some non-zero difference between V1 and $V_W$.

In other embodiments the present disclosure provides an apparatus for intermittently cutting a moving target web, comprising a first perforating station comprising a first knife roll which has at least one knife member and is rotatable to provide an operative knife-member rotational position; a first anvil roll which has at least one anvil member the anvil roll positioned to provide a first operative nip region between the anvil roll and the knife roll; a second perforating station comprising a second knife roll which has at least one knife member and is rotatable to provide an operative knife-member rotational position; a second anvil roll, the anvil roll positioned to provide a second operative nip region between the anvil roll and the knife roll; a transport system which moves a substantially continuous target web at a web speed ($V_W$) through the nip region; and a control system which synchronizes the rotational positioning of the first knife member with a rotational positioning of the second knife member.

In still other embodiments the present invention provides an apparatus for intermittently cutting a moving target web, comprising a first perforating station comprising a first rotating knife roll having at least one knife member to provide an operative knife-member speed and a first anvil member, the first rotating knife roll driven by a first motor; a second perforating station comprising a second rotating knife roll having at least one knife member to provide an operative knife-member speed and a second anvil member, the second rotating knife roll driven by a second motor; servo drive controllers having an internal power structure operatively connected to the first and second motors, regulating the application of power to the motor through the internal power structure of the servo drive controller; and a transport system which moves a substantially continuous target web.

In yet other embodiments the present invention provides a method for intermittently cutting a moving target web, comprising: rotating a first knife roll having at least one knife member to provide an operative knife-member speed (V1) and rotating a first anvil member having an anvil member to provide an operative anvil-member speed (V2), wherein V1 does not equal V2; rotating a second knife roll having at least one knife member to provide an operative knife-member speed and rotating a second anvil member having an anvil member to provide an operative anvil-member speed; positioning the first knife roll and first anvil roll to provide a first operative nip region therebetween; positioning the second knife roll and second anvil roll to provide a second operative nip region therebetween; continuously moving the target web through the first and the second operative nip regions at a target web speed ($V_W$) in the machine direction; and coordinating the rotational speed of the first and the second knife members to provide an operative, cutting engagement between the knife member and its cooperating anvil member to thereby cut the moving web, while maintaining the above said non-zero operative speed difference between the knife-member and the anvil-member at cut locations which are intermittently spaced along a machine-direction of the web.

DETAILED DESCRIPTION

Figure 1:
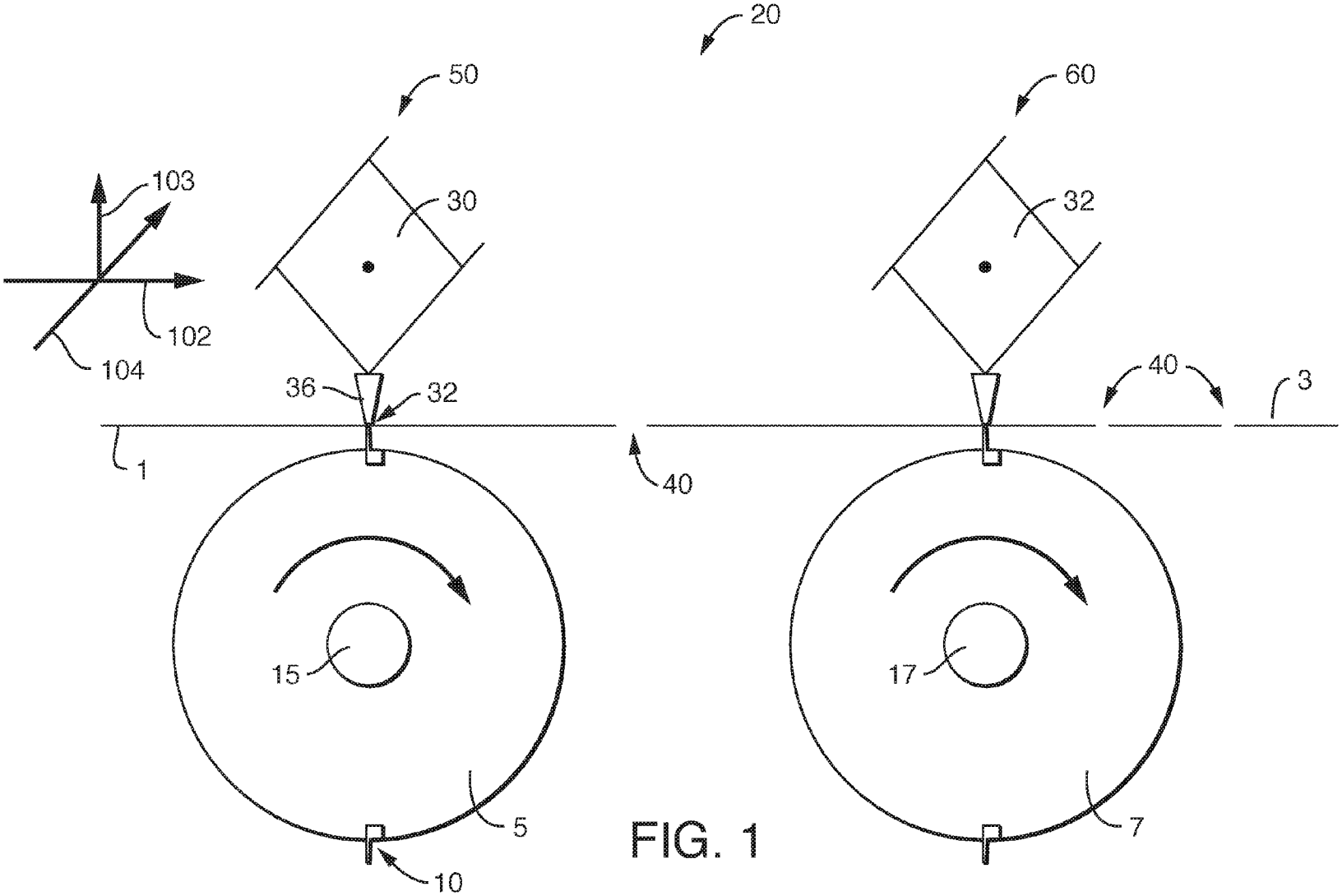
FIG. 1 illustrates one embodiment of a perforating apparatus according to the present disclosure.

Generally the apparatus of the present invention is applicable to cutting a line of perforations across a web, such as a web of tissue paper, moving at high speeds. The apparatus preferably comprises two or more perforating stations in synchronized control with one another, each apparatus preferably perforating the web at a different position. In the most basic sense each perforating station comprises a knife roll and an anvil, which are positioned relative to one another to create a nip there between through which a moving web passes and is cut.

Generally the present invention provides an apparatus and a method which can intermittently produce perforations, or can otherwise intermittently cut a moving target web and includes rotating a knife roll having at least one knife member to provide an operative knife-member speed (V1), and rotating an anvil roll having an anvil member to provide an operative anvil-member speed (V2). The knife roll and anvil roll have been positioned to provide an operative nip region therebetween, and a substantially continuous target web has been moved at a selected web speed ($V_W$) through the nip region. The speed of the knife member can be coordinated with a speed of its cooperating anvil member and the speed of the web to help provide the operative, cutting engagement between the knife member and its cooperating anvil member.

Two or more of the aforementioned perforating apparatuses are arranged in parallel with one another and the relative speeds of the knife-members are controlled such that they have the same speed. That is, if a first rotating knife roll having at least one knife member has an operative knife-member speed (V1) then a second rotating knife roll having at least one knife member also has an operative knife-member speed (V1). Synchronization of the first and the second knife rolls may be accomplished using phase control with a dedicated servo drive controller for each knife roll. Suitable servo drive mechanisms and encoder mechanisms for the knife roll and anvil roll are commercially available and well known in the art. Other means of synchronization are possible and will be discussed in more detail below.

In conventional arrangements, the knife roll is generally a moving, rotating roll, and the anvil is generally a stationary component, however, in certain alternate embodiments the anvil may be moveable, such as a rotating anvil roll. In the method and apparatus that includes the invention, the terms knife and anvil are employed to indicate that there are two cutting components. Since both the knife and anvil are providing a cutting force to the moving web, and since the relative arrangements of the knife and anvil rolls can be substantially interchangeable, the distinction between the knife and anvil rolls may be less defined. In a particular aspect of distinction, the knife roll has knife members (e.g. knife blades) with nonlinear or notched operating edges, and the anvil roll has anvil members (e.g. anvil blades) with substantially straight operating edges.

With reference to FIG. 1, the perforating stations 50, 60 are arranged such that the first station 50 provides a first set of perforations 40 and the second station 60 provides a second set of perforations 40. The perforating stations 50, 60 are synchronized such that each perforating station will perforate the web at a fixed distance. Each perforating station 50, 60 utilizes a rotary cutting concept and is applicable for making perforations on a web of tissue paper and other perforation applications. In one embodiment two adjacent rotating perforating rolls are used to generate two distinct lines of perforations on the web. In this manner the web perforator 20 has been illustrated with two perforating stations 50, 60 spaced horizontally. The perforating stations 50, 60 are synchronized such that the cuts or perforations will not occur at the same point. Although the invention is illustrated as having two perforating stations 50, 60 spaced horizontally, one skilled in the art would appreciate that additional perforating stations may be added and that the invention is not to be limited to two perforating stations and that other orientations are also possible within the scope of the invention.

With continued reference to FIG. 1, the perforating apparatus can have a lengthwise, machine-direction 102 which extends longitudinally, a lateral cross-direction 104 which extends transversely, and an appointed z-direction 103. For the purposes of the present disclosure, the machine-direction 102 is the direction along which a particular component or material is transported length-wise along and through a particular, local position of the apparatus and method. The cross-direction 104 is aligned perpendicular to the local machine-direction 102 along the local plane of the material targeted for work, and can lie generally parallel to the local horizontal. The z-direction is aligned substantially perpendicular to both the machine-direction 102 and the cross-direction 104, and extends generally along a depth-wise, thickness dimension of the appointed material targeted for work.

Accordingly, a perforation apparatus that can intermittently produce lines of perforations 40, or can otherwise intermittently cut a moving target web 1 includes a pair of perforating stations 50, 60. The perforating stations may be substantially the same, or may be different. For simplicity, the perforating stations are described and illustrated as being substantially the same. Accordingly, the apparatus will be described with reference to only one of the perforation stations. The perforating station preferably comprises a rotating knife roll 5 having at least one knife member 9 to provide an operative knife-member position and speed, and a fixed anvil 30 having at least one anvil member or knife 36. The knife roll and anvil roll have been positioned to provide an operative nip region 32 therebetween, and a substantially continuous target web 1 moved at a selected web speed through the nip region. A rotational positioning of the knife roll knife member has been coordinated with the positioning of its cooperating anvil member to provide an operative cutting engagement between the knife member and its cooperating anvil member, thereby cutting the moving web at cut locations which are intermittently spaced along a machine-direction 102 of the target web 1.

In particular aspects, the knife roll 5 can include a plurality of two or more, and alternatively three or more, knife-members 10 that are spaced apart along an outer circumference of the knife roll 5. The anvil 30 can include a plurality of two or more, and alternatively three or more, anvil-members 36 that are spaced apart along an outer perimeter of the anvil 30.

Preferably the two or more knife rolls 50, 60 are driven by separate drive means 15, 17, which are controlled by a central control system (not illustrated in FIG. 1) that coordinates the rotational positioning of the knife members of the two or more knife rolls so as to coordinate the cutting of each perforating station relative to one another so that the moving web may be cut in a synchronized manner.

The cutting method and apparatus 20 can thereby form and produce a cut web 3, and the cut web 3 includes cuts or perforations 40 imposed by each perforating station. In a particular aspect, each cut can be distributed in a predetermined pattern or array. In another aspect, an individual line or other individual array of perforations which extends along the cross-direction 104 of the web can be produced at predetermined cut locations that are intermittently spaced apart at substantially non-contiguous areas or regions along the machine-direction 102 of the cut web 3.

Figure 2:
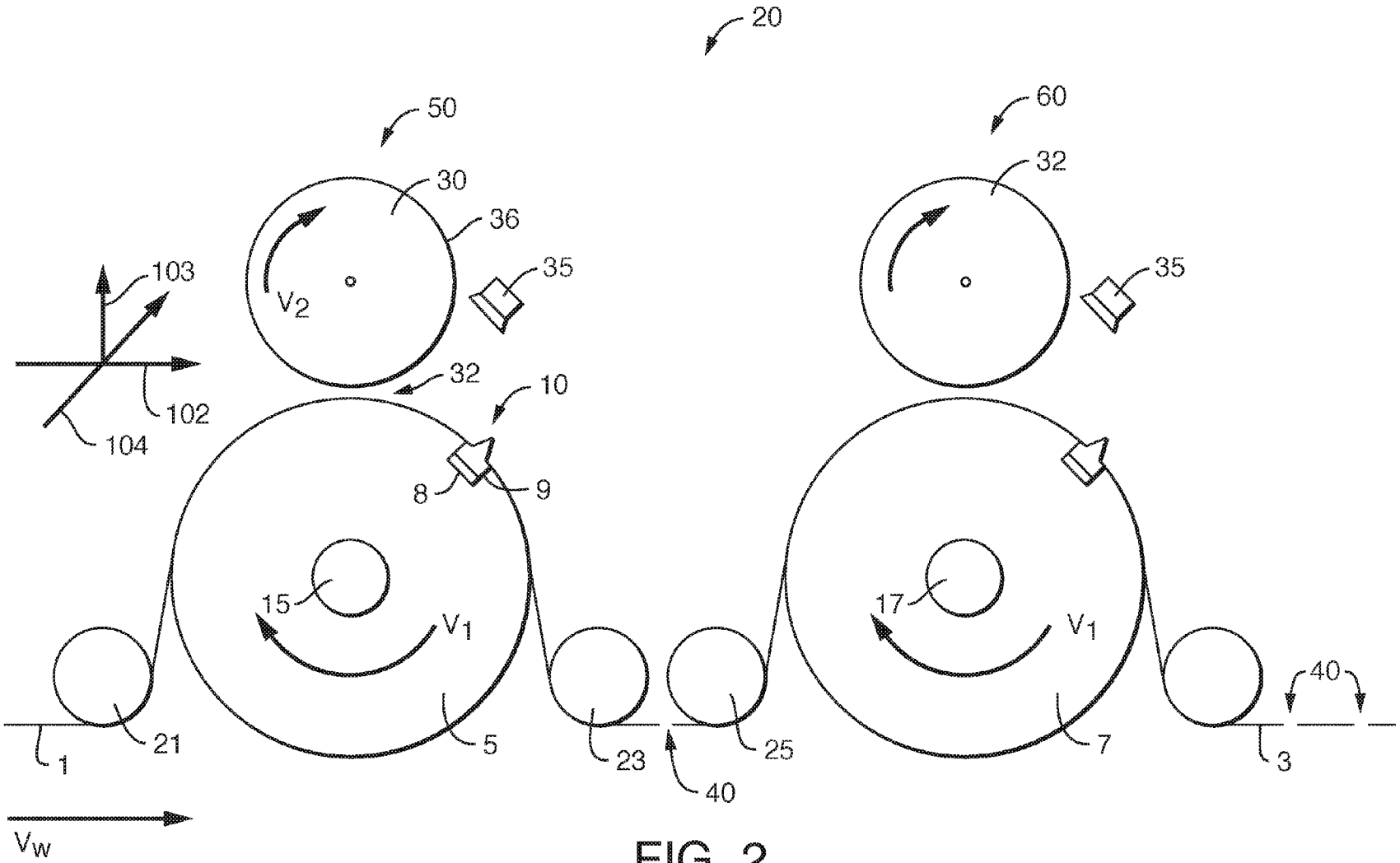
FIG. 2 illustrates one embodiment of a perforating apparatus according to the present disclosure.

With reference to FIG. 2, an alternate embodiment for perforating a web using multiple perforating stations is illustrated. Shown is another embodiment for perforating a web using multiple perforating stations 50, 60, comprising an incoming web 1, an outgoing perforated web 2 having a first set of perforations, an outgoing web 3 having two sets of perforations, guide rollers 21, 23, 25 and 27, a first and a second rotating knife roll 5, 7 and a first and a second anvil roll 30, 32. The first and second rotating knife rolls 5, 7 are provided with suitable drive means (15, 17 drive means for driving the first and second rotating knife rolls 5, 7) and rotate in the direction of their respective arrows as shown.

Each knife roll 5, 7 contains multiple pattern holding stations 9 (four shown) which contain a pattern of protruding perforation elements 10 which are arranged in the desired perforation pattern and protrude from the surface of the pattern roll. The number of elements can be adjusted to the length between perforating patterns and the diameter of the pattern roll. Advantageously, the pattern holding stations 9 can be replaceable so that the resulting perforation pattern can be changed or the protruding perforation elements can be replaced due to wear. Elements can also be placed at an angle to the axis of the roll to spread out the force of impact of the perforating pattern with the anvil. Alternatively, the elements can be placed in a helix pattern around the pattern rolls 5, 7 and the angle of the pattern rolls 5, 7 adjusted for the correct placement of the pattern in the cross machine direction of the web. The circumferential width of the pattern holding stations 9 depends upon the width of the perforation pattern. Where perforation elements are not present, the surface of the pattern holding station 9 is substantially flush with the surface of the pattern rolls 5, 7 with suitable clearance such that web does not contact the anvils 30, 32. Optionally, the pattern holding stations 9 can be supported by a resilient material 8, such as rubber, in order to further cushion the impact of the perforation elements against the anvil member to further improve the wear characteristics of the apparatus. The pattern holding stations can alternatively be supported by liquid- or gas-filled bladders designed to absorb more shock and to further improve the wear characteristics of the apparatus.

In operation, in one embodiment, the anvil is positioned under tension and urged against the knife roll with sufficient pressure to create the perforations in the web. As shown, a cleaning brush or spray device 35 can be provided to maintain the surface of the anvil by removing dust and debris that may collect during the perforation step.

In other embodiments the anvil may be a rotatable anvil roll having at least one anvil disposed along its surface. The rotatable anvil roll is driven by a drive means, which may be coordinated with the rotational position and speed of a corresponding knife member to create a nip there between and cut a web passing through the nip. For example, the anvil roll drive means may be controlled to provide a speed differential between the anvil-member speed and the knife-member speed. Particularly preferred speed differentials are described in more detail below.

The method and apparatus can provide better control of the relative speeds at which the cooperating anvil members and knife members contact or otherwise engage each other in the nip region between the knife and anvil rolls. In desired arrangements, the method and apparatus can help provide selected speed differences or differentials between the moving web, the moving knife member and its cooperating, moving anvil member in the nip region to help provide a more reliable and more consistent perforating or other cutting operation. Impact loads between the knife member and its cooperating anvil member can be more efficiently and effectively controlled, and a more consistent yet lower force can be provided between the anvil and knife-members. As a result, the method and apparatus can provide more reliable and consistent cutting, and can require less maintenance.

In a further feature, the speed of an individual knife-member can be selectively controlled to provide desired performance. The knife-member speed can be configured to provide speed differentials between the knife-member and the web or the knife-member and the anvil member. For example, the knife-web speed difference or speed differential, and the knife-web speed difference may be configured to be greater than zero or less than zero. The speed of the knife-member can, for example, be a selected percentage of the speed of the target web. In particular aspects, the speed of the knife-member can be at least a minimum of about 70 percent of the speed of the target web. The knife-member web speed can alternatively be at least about 75 percent of the target web speed, and can optionally be at least about 80 percent of the target web speed to provide improved efficiencies. In other aspects, the knife-member speed can be up to a maximum of about 130 percent of the speed of the target web. The knife-member speed can alternatively be up to about 125 percent, and can optionally be up to about 120 percent of the target web speed to provide desired effectiveness. Accordingly, the speed of the knife-member can be plus or minus (±) 30 percent of the speed of the target web. The knife-member speed can alternatively be ±25 percent of the speed of the target web, and can optionally be ±20 percent of the speed of the target web to provide desired benefits.

If the speed of the knife-member is outside the desired values, undesired strains can be imparted to the moving target web. For the purposes of the present disclosure, the knife-member speed is determined substantially at the operative, radially-outboard, distal edge of the knife-member.

Another feature of the method and apparatus can have a configuration in which a speed of an individual anvil-member speed has been selectively controlled to provide desired performance. The knife-member speed and the anvil-member speed can be configured to provide a knife-anvil speed difference or speed differential, and the knife-anvil speed difference may be configured to be greater or less than zero. For example, the speed of the anvil-member can be configured to be a selected percentage of the speed of the cooperating knife-member, and in a particular aspect, the speed of the anvil-member can be at least a minimum of about 75 percent of the speed of the cooperating knife-member. The anvil-member speed can alternatively be at least about 80 percent of the cooperating knife-member speed, and can optionally be at least about 90 percent of the cooperating knife-member speed to provide improved efficiencies. In other aspects, the speed of the anvil-member can be up to a maximum of about 125 percent of the speed of the cooperating knife-member. The anvil-member speed can alternatively be up to about 120 percent of the cooperating knife-member speed, and can optionally be up to about 110 percent of the cooperating knife-member speed to provide desired effectiveness. Accordingly, the speed of the anvil-member can be ±25 percent of the speed of the knife-member. The anvil-member speed can alternatively be ±20 percent of the speed of the knife-member, and can optionally be ±10 percent of the speed of the knife-member to provide desired benefits. In desired arrangements, the anvil-member speed can be based on the design parameters of the knife roll, the desired speed differential for perforating the web, and the speed of the web.

If the speed of the anvil-member is outside the desired values, undesired strains can be imparted to the moving target web. For the purposes of the present disclosure, the anvil-member speed is determined substantially at the operative, radially-outboard, distal edge of the anvil-member.

Another feature of the method and apparatus can include a controlled or regulated web speed of the target web. In particular aspects, the web speed of the target web can be at least a minimum of about 500 m/min. The web speed can alternatively be at least about 750 m/min, and can optionally be at least about 1,000 m/min to provide improved efficiencies. In other aspects, the web speed can be up to about 1,500 m/min, such as from about 1,000 to about 1,500 m/min.

To provide for increased perforation speeds and uniform perforated sheet lengths, the disclosure further provides a means for synchronizing the operation of a plurality of motors used to drive the individual perforating stations. To control the operation of such motors requires monitoring the position of the output shaft of each motor. Typically, a position transducer, such as a resolver connected to the output shaft of the motor, can provide an indication of the position of the shaft. The synchronization of a plurality of motors is preferably carried out by determining the position of each rotating motor shaft by an associated encoder and controlling the position and speed of the drive shaft with a drive controller. Appropriate corrective command messages may be developed for each motor by its associated universal drive controller and that the foregoing command messages may be transmitted to the proper motor.

In one embodiment synchronization of two or more discrete perforating stations may be accomplished using phase control with a single drive for each knife roll. Preferably the knife rolls are similarly sized, have approximately the same skew angle and are disposed on a common frame. However in certain embodiments the rolls may be differently sized and may be skewed differently.

To control the operation of the knife roll drive motors requires monitoring the position of the output shaft of each motor. Typically, a position transducer, such as an encoder connected to the shaft of the motor, can provide an indication of the position of the shaft. To maintain synchronization of a plurality of motors requires that the position of each motor shaft be determined by its associated encoder; that as a result of the foregoing determination, appropriate corrective command signals be developed for each motor by its associated servo drive controller; and that the foregoing command signals be transmitted to the proper motor. Each of the foregoing steps preferably occurs simultaneously at each motor in order to effect motor synchronization. In one embodiment synchronization of the perforating apparatus may be accomplished by using phase control with a dedicated servo drive controller for each knife roll. Suitable servo drive mechanisms and encoder mechanisms for the knife roll and anvil roll are commercially available and well known in the art.

Figure 3:
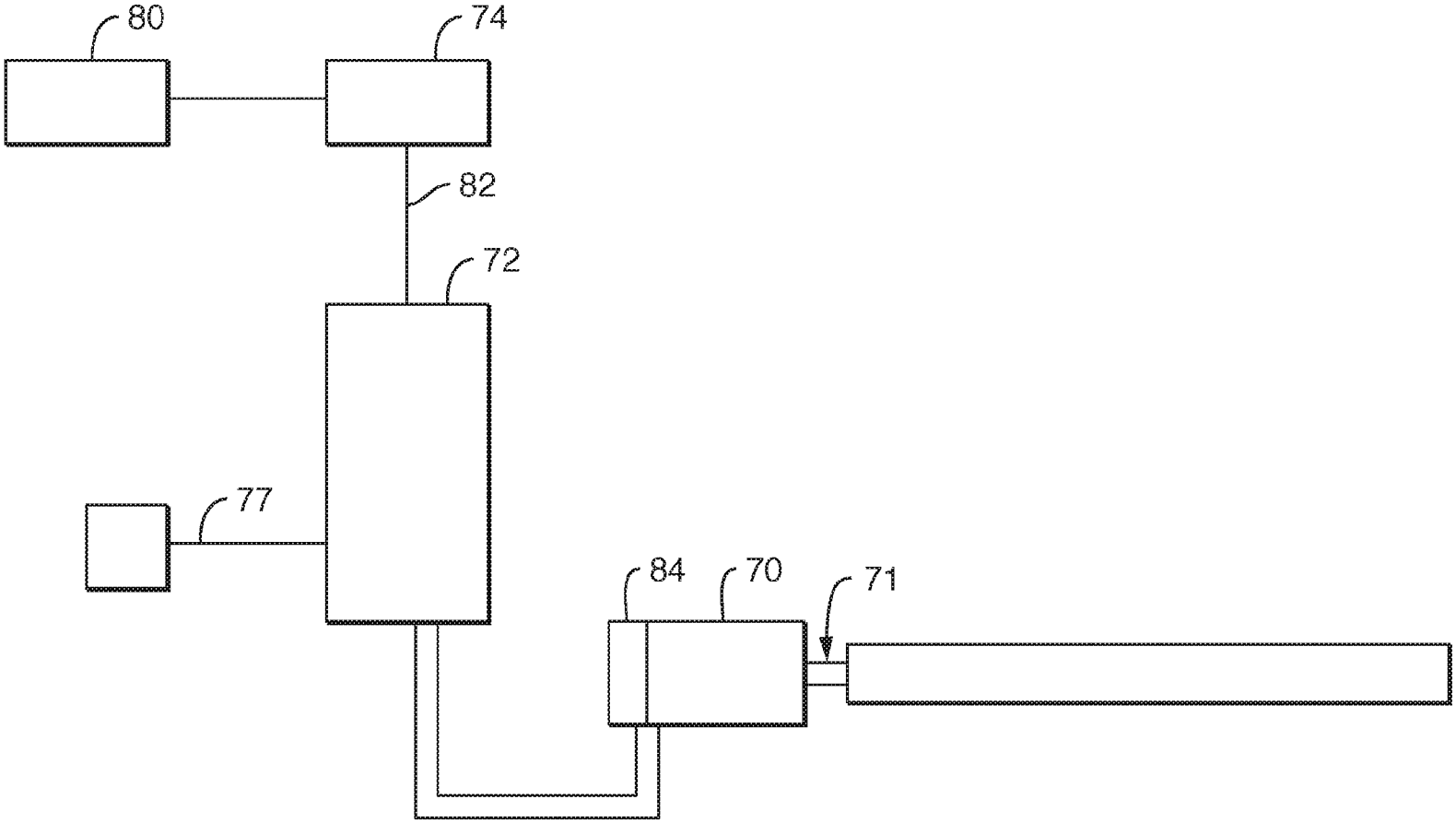
FIG. 3 illustrates one embodiment of a control mechanism for synchronizing the drive motors of a perforating apparatus according to the present disclosure.

Referring to FIG. 3, there is one embodiment of a control and drive mechanism for controlling and driving a pair of spaced a part knife rolls. A rotational force of the motor 70 is transmitted to the rotating shaft of the knife roll (not illustrated) via an output shaft 71. Preferably the control mechanism permits the coordination and synchronization of the direction and velocity of movement of the first knife roll about the axis of a first rotating shaft with that of the second knife roll about the axis of a second rotating shaft. In this manner the phases of the first and second knife rolls are synchronized with each other and their cutting may be coordinated in such a manner so as to reduce the overall vibrational energy transferred to the web, while still maintaining a high web speed and at least about 7,000 impacts per minute. Further, loads applied to the motor and a power drive portion can be equalized, to reduce the vibration of the apparatus and improve the durability thereof.

Preferably the drive mechanisms and their respective controls are identical for the first and second knife rolls. Accordingly, the drive mechanisms and controls will be detailed with reference to a single knife roll. In one embodiment power is provided to the motor 70 by a servo drive controller, shown generally by the numeral 72, and control is performed by a programmable logic controller 74, which may be in communication with a computer 80. The servo drive controller 72 includes all of the necessary power conversion and regulation and is in communication with the programmable logic controller 74 through the communication link 82. The servo drive controller 72 performs the AC to DC conversion and contains the associated electronics and power structure to produce a pulse width modulated signal to the motor, input and output signal processing and the associated motor encoder feedback. The programmable logic controller 74 is common for any drive type, thus providing a common programming environment and control architecture for all types of drives. The remaining module, such as the drive technology module and its associated power module are the only system components that change from one power technology to another, such as from AC drives to DC drives and vice versa.

The servo drive controller 72 performs the necessary control of its associated motor 70 through the regulation of separate velocity, position and current loops internal to the drive. The encoder feedback is connected directly to the drive so that the motor rotational position is always known and processed for the desired control. The servo drive controller 72 also provides connections 77 for other drive input/output devices for other signal processing that needs to occur for the desired control.

The servo drive controller 72 is connected to the programmable logic controller 74 by a cable link 82. Based on the control algorithms programmed in the associated programmable logic controller 74 reference information is fed from the programmable logic controller 74 to the servo drive controller 72 through the cable link 82. The servo drive controller 72 receives the associated reference information and regulates each of the respective position, velocity and current loops to match the reference commands.

For each respective motor 70, an associated servo drive controller 72 is required. However, in certain embodiments a single programmable logic controller may be in communication with the separate servo drive controllers. Where each motor is controlled by a separate servo drive control and the servo drive controls are in communication with a single programmable logic controller, synchronization of the two drive axes would occur within the programmable logic controller so that proper regulation of the position and velocity of the two axes would occur. Each respective servo drive controller would communicate its associated position, velocity and current information to the programmable logic controller for monitoring the performance of the associated control algorithms. Diagnostic and other associated servo drive controller specific data can be obtained in the programmable logic controller through the use of the communication interface.

To synchronize the operation of each drive motor in the perforating stations requires the monitoring of the position of the output shaft of each motor. Typically, a position transducer, such as an encoder 84 connected to the output shaft 71 of the motor 70, can provide an indication of the position of the shaft 71. To maintain synchronization of a plurality of motors requires that the position of each motor shaft be determined by its associated encoder; that as a result of the foregoing determination, appropriate corrective command signals be developed for each motor by its associated servo drive controller; and that the foregoing command signals be transmitted to the proper motor. Each of the foregoing steps preferably occurs simultaneously at each motor in order to effect motor synchronization. In essence, the programmable logic controller 74 is synchronized with the associated servo drive controller 72 by transmitting synchronization data over the associated cable link. If there is a plurality of servo drive controllers 72, each would be synchronized through the reference signals received from the common programmable logic controller 72 and its associated control algorithms and control processes that keep all of the associated axes in a given programmable logic controller synchronized.

Where multiple servo drive controllers are employed, each servo drive controller receives its own respective reference signals from the programmable logic controller. Once the movement has been initiated for each motor, monitoring of the encoder feedback device at the servo drive controller occurs. The servo drive controllers monitor the motor position and velocity data from the encoder and regulate the position, velocity and current loops in order to achieve the commanded reference signals issued by the programmable logic controller.

By providing at least two perforating stations in synchronized control with one another the impact energy applied by each of the stations may remain substantially unchanged; however, both the web speed and the total impact rate may be increased dramatically. For example, in one particularly preferred embodiment the present invention provides at least two synchronized perforating stations which are capable of delivering a total of 7,000 impacts per minute or more, such as from about 7,000 to about 8,000 impacts per minute, with low vibrational energy and without damaging the web. In this manner, high web velocities may be obtained such as greater than about 1,000 m/min and more preferably greater than about 1,250 m/min, such as from about 1,250 to about 1,500 m/min.

In further aspects, the two rotating perforating stations operate at different speeds to create lines of perforations or cuts that extend transversely across the web, and are spaced-apart at varying distances along the machine-direction of the web. In other aspects, the perforating stations can be configured to move out-of-phase with one another. The various aspects of roll synchronization can provide increased operational flexibility while maintaining substantially the same path of the target web.

What we claim is:

1. A method for intermittently cutting a moving target web, comprising:

a. rotating a first knife roll having at least one knife member to provide an operative knife-member speed (V1);

b. rotating a second knife roll having at least one knife member to provide an operative knife-member speed (V1);

c. positioning the first knife roll and a first anvil member to provide a first operative nip region therebetween;

d. positioning the second knife roll and a second anvil member to provide a second operative nip region therebetween;

e. continuously moving the target web through the first and the second operative nip regions at a target web speed ($V_W$) in the machine direction wherein there is some non-zero operative speed difference between the operative knife-member speed (V1) and the target web speed ($V_W$) created by a rotational speed difference between the first and second knife members and first and second anvil members; and f. coordinating the rotational speed of the first and the second knife members to provide an operative cutting engagement between the first and the second knife members and the first and second anvil members to thereby cut the moving web while maintaining the above said non-zero operative speed difference between the first and second knife members and first and second anvil members at cut locations which are intermittently spaced along a machine-direction of the web.

2. The method of claim 1 wherein the step of coordinating the rotational speed of the first and the second knife members is performed by a knife encoder operatively connected to the first and second knife rolls, a servo drive controller, a programmable logic controller and a computer in operative communication with one another.

3. The method of claim 1 wherein the first and second perforating stations have been configured to deliver at least about 7,000 impacts per minute to the target web.

4. The method of claim 1 wherein the first and second perforating stations have been configured to deliver greater than about 7,500 impacts per minute to the target web.

5. The method of claim 1 wherein the target web speed ($V_W$) is at least about 1,000 m/min.

6. The method of claim 1 wherein the operative knife-member speed (V1) is from about 70 percent to about 130 percent of the target web speed ($V_W$).

7. The method of claim 1 wherein the operative knife-member speed (V1) is less than the target web speed ($V_W$) such that the operative knife-member speed (V1) is from about 70 to about 95 percent of the target web speed ($V_W$).

8. The method of claim 1 wherein the operative knife-member speed (V1) is greater than the target web speed ($V_W$) such that the operative knife-member speed (V1) is from about 105 to about 140 percent of the target web speed ($V_W$).

* * * * *